US005205270A

United States Patent [19]

Szente

[11] Patent Number: 5,205,270

[45] Date of Patent: Apr. 27, 1993

[54] MAGAZINE FOR COMPRESSED GAS SINGLE-SHOT BOLT-ACTION PELLET SHOULDER GUNS

[76] Inventor: Pedro A. Szente, 80 E. Portola Ave., Los Altos, Calif. 94022

[21] Appl. No.: 890,845

[22] Filed: Jun. 1, 1992

[51] Int. Cl.[5] ..... F41B 11/02

[52] U.S. Cl. ..... 124/50; 124/49; 124/56

[58] Field of Search ..... 124/41.1, 45, 49, 50, 124/56, 63–67; 42/6, 87, 88

[56] References Cited

U.S. PATENT DOCUMENTS

| | | | |
|---|---|---|---|
| 7,496 | 7/1850 | Percival et al. | 42/6 |
| 1,365,509 | 1/1921 | Larson | 42/6 X |
| 2,009,256 | 7/1935 | Gensmer | 124/50 X |
| 2,462,922 | 3/1949 | Temple | 124/66 X |
| 2,814,285 | 11/1957 | Yamauchi | 124/49 X |
| 3,111,121 | 11/1963 | Baggott | 124/67 |
| 3,572,311 | 3/1971 | Baer | 124/41.1 X |
| 3,808,723 | 5/1974 | Erixon | 42/6 |
| 4,688,344 | 8/1987 | Kim | 42/88 X |
| 4,850,328 | 7/1989 | Sindel | 124/41.1 X |
| 5,166,457 | 11/1992 | Lorenzetti | 124/49 X |

FOREIGN PATENT DOCUMENTS 1420158 10/1965 France ..... 124/49

*Primary Examiner*—Randolph A. Reese
*Assistant Examiner*—John Ricci

[57] ABSTRACT

A magazine is provided for rifles and smooth barrel shoulder guns of the single shot type that use pellets as projectiles, that further have loading mechanisms which include a bolt, and that use as propellant either compressed air (pre-charged or provided by a pump), or carbon dioxide cartridges. The magazine of this invention will permit the operation of these guns as repeaters. The magazine stores pellets in reservoir ducts built into a body. The pellets are fed one at a time into a chute duct for rifle loading. The motion of the pellets within the magazine is propelled by gravity. A guide, which is part of the magazine, helps the operation of filling the magazine with pellets. This guide has a gate which prevents filling the magazine with pellets turned around backwards. The preferred embodiment of the invention may be attached and removed from the rifles by means of built-in clamps, or may be built onto a rifle especially designed to feature it. Another embodiment of the invention provides a magazine which may be pre-filled with pellets before installing it on guns of the type mentioned, permitting the use of magazines of this type as clips.

25 Claims, 3 Drawing Sheets

MAGAZINE FOR COMPRESSED GAS SINGLE-SHOT BOLT-ACTION PELLET SHOULDER GUNS

BACKGROUND OF THE INVENTION

Rifles or smooth barrel shoulder guns utilizing compressed air (pre-charged or pump pneumatic) or compressed carbon dioxide cartridges to propel projectiles have been in existence for many years. The specification of the invention relates only to the part of these rifles or smooth barrel shoulder guns that further have a bolt-action as part of the loading mechanism; the specification of the invention henceforth often refers to any of such restricted class of guns simply as "rifles" or "rifles", and the references to "rifles" include smooth barrel shoulder guns. Some of these rifles use spherical, steel projectiles (BB's), others utilize lead pellets with specific shapes to optimize performance, others still are designed to utilize either type. Some rifles have mechanisms for loading projectiles of the BB type, so that these rifles may operate as bolt-action repeater rifles only when using BB's. The mechanical systems for storing and feeding BB's to load these projectiles into repeater rifles only work due to two facts: first, the orientation of the spherical projectile is unimportant, and second, the projectiles are magnetic so that they are not lost during loading. The front to back orientation with which lead pellets are loaded into these gas rifles is critical because of the asymmetrical shape these pellets have for optimum performance. Furthermore, the special shape these pellets have causes them to be easily susceptible to deformation, since they have very thin walls in some places, and they are very soft, being made of lead. A system that would guide such pellets into the breech of a gas rifle must do so without deforming them. The existing devices that provide rifle operation in the repeater mode are of two general classes: one class requires very complex and expensive mechanisms to avoid pellet deformation and jamming during loading; the other class is exemplified by a magazine that merely stores and aligns the pellets before loading, requiring manual advance of a pellet chamber by the user. The magazine of this latter class further require care while filling them with pellets so that pellets are not inserted backwards.

An object of the invention is to provide a magazine which will make it possible to operate as repeaters single shot, bolt-action, compressed air (pre-charged or pump pneumatic) or carbon dioxide cartridge pellet rifles.

Another object of the invention is to provide a magazine which operates by gravity for bolt-action, single shot compressed air (pre-charged or pump pneumatic) or carbon dioxide cartridge pellet rifles.

Another object of the invention is to provide a magazine which can be filled with a plurality of pellets after being attached to a bolt-action, single shot compressed air (pre-charged or pump pneumatic) or carbon dioxide cartridge pellet rifle.

Another object of the invention is to provide a magazine which can be permanently built into a bolt-action, single shot compressed air (pre-charged or pump pneumatic) or carbon dioxide cartridge pellet rifle.

Another object of the invention is to provide a magazine that can be pre-filled with a plurality of pellets and that will work as a clip for attachment to bolt-action, single shot compressed air (pre-charged or pump pneumatic) or carbon dioxide cartridge pellet rifles.

Another object of the invention is to provide a magazine which has a guide to make it easy to fill the magazine with pellets for bolt-action, single shot compressed air (pre-charged or pump pneumatic) or carbon dioxide cartridge pellet rifles.

Another object of the invention is to provide a magazine which prevents loading pellets backwards into rifles of the bolt-action, single shot compressed air (pre-charged or pump pneumatic) or carbon dioxide cartridge type.

SUMMARY OF THE INVENTION

The invention provides a magazine which enables the operation as repeaters the rifles and smooth barrel shoulder guns that were originally built as single shot guns, of the type that use pellets as projectiles, that further have loading mechanisms which include a bolt, that use as propellant either compressed air (pre-charged or provided by a pump), or carbon dioxide cartridges.

In the magazine of the invention one or two reservoir ducts and one chute duct are formed into a body of preferably molded plastic to store a plurality of pellets. During the operation and use of the magazine of the invention the pellets are free to move propelled by gravity, rolling around their axes with a movement along the axes of the ducts, making it possible to dispense one single pellet at a time to the breech of rifles.

One embodiment of the invention has two pellet reservoir ducts and one pellet chute duct, all three ducts connected at one of their ends. The other end of the first of the reservoir ducts is closed, the other end of the second reservoir duct is opened or closed by a sliding cover, and through the opening of this reservoir duct the magazine is filled with pellets. The other end of the chute duct is shaped in such a way as to be closed by the rifle's bolt when this bolt closes the rifle's breech, thus the closed bolt will block a pellet in the magazine's pellet chute duct. The ducts are formed by channels with cross sections such that they are able to accommodate pellets according to a particular caliber and shape, the reservoir ducts having lengths sufficient to accommodate a plurality of pellets in them lying side by side to one another, instead of lying front to back. The cross section of the ducts is uniform along their length. The length of the chute duct is such that it can accommodate only one pellet. The plane that contains the axes of the reservoir ducts and the chute duct (plane related to the movement of pellets during operation of magazine) is perpendicular to the rifle's bore axis. The orientation of the pellet reservoir ducts' axes in relation to the pellet chute duct axis is such that during pellet loading one pellet is in the chute duct and the pellets that may be in the pellet reservoir ducts roll away from the junction of the three ducts, so that only one pellet at a time may fall into the rifle's breech when the rifle's bolt is pulled back to open that breech. Feeding one pellet from the reservoir duct into the chute duct before loading it into the rifle is done by a small rotation of the rifle around its bore axis while holding the rifle with this axis approximately in a horizontal position. To control the motion between the pellet reservoir ducts and the pellet chute duct the invention provides a bump in the form of a cusp near the junction of these ducts. During rifle loading, the cusp routs a pellet from one of the pellet reservoirs into the chute duct while preventing this pellet to move into the other reservoir duct. During magazine filling the cusp allows the pellets to move past the chute duct so that both reservoirs may be filled with pellets. The magazine has a pellet filling guide attached to it to make it easy to fill the magazine with pellets. This guide further has a shaped gate that prevents pellets from being loaded backwards into the magazine, and, therefore, to the rifle. The magazine may be attached to or removed from a rifle by means of especially shaped flexible bars which are part of the magazine, or the body of the magazine may be manufactured as an integral part of a rifle especially designed to feature it.

Another embodiment of the invention differs from the embodiment described above in that it has only one reservoir duct and that it further has a movable pin to allow or prevent pellets from moving out of the magazine's rifle loading hole. This magazine may be filled with pellets before attaching it to the rifle. Several such magazines may be pre-filled with pellets, thus making these magazines operate as clips. After attaching one such magazine to the rifle, the movable pin is retracted and the rifle may be loaded with pellets.

DETAILED DESCRIPTION OF THE INVENTION

Figure 1:
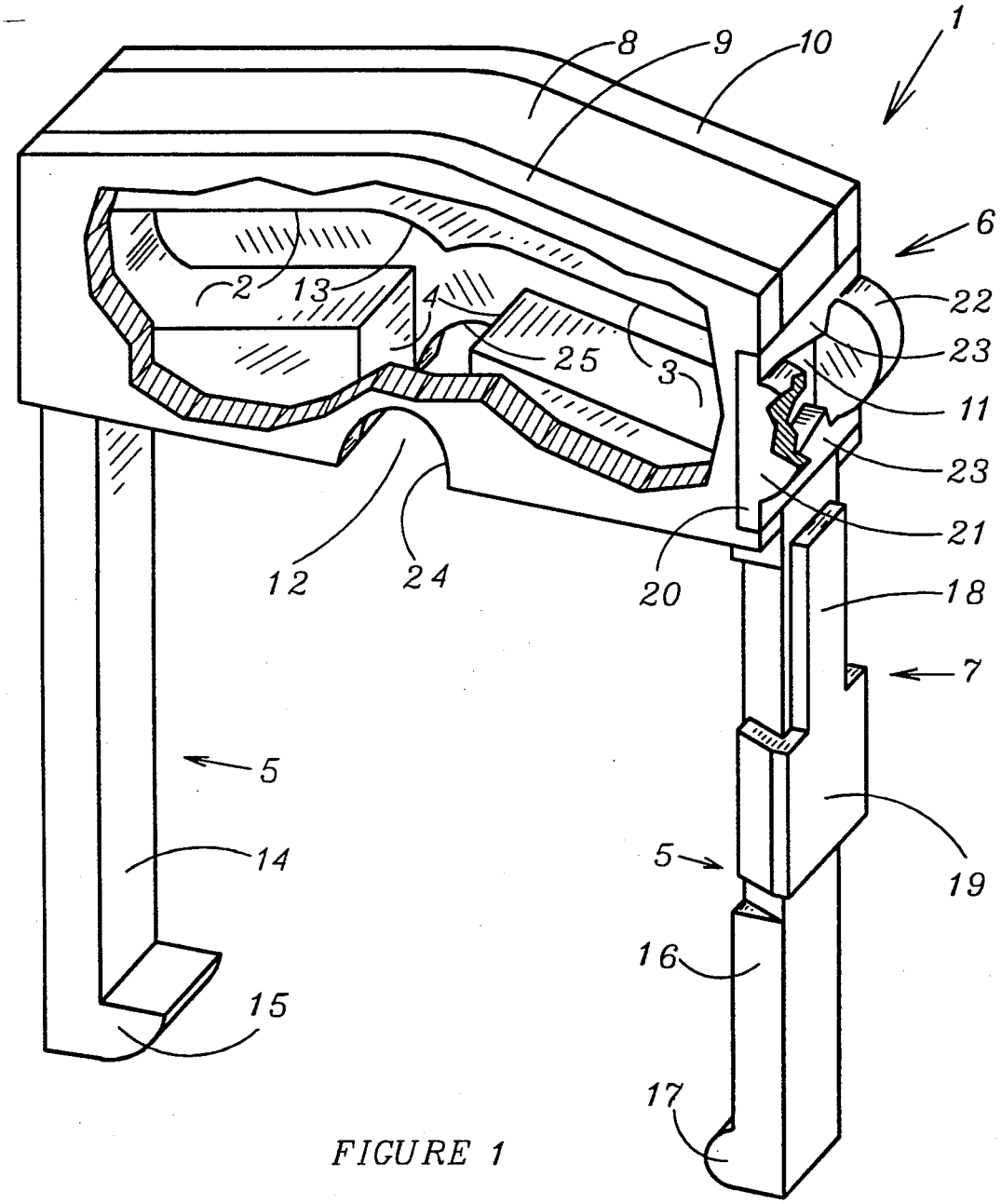
FIG. 1 shows a sectional perspective view of a preferred embodiment of the invention.

FIG. 1 shows the preferred embodiment of the magazine 1 of the invention. It shows a pellet reservoir duct 2, a pellet reservoir duct 3, a pellet chute duct 4, an attachment means 5, a magazine filling guide 6, and a sliding cover 7. Ducts 2, 3 and 4 are formed by channels built into a plate block 8 and cover plates 9 and 10. The width of the channels that form ducts 2, 3, and 4 slightly exceeds the caliber of the rifle pellets to be used, and the thickness of block 8 slightly exceeds the lengths of those pellets. Thus, pellets loaded into the magazine will be free to roll along inside ducts 2, 3 and 4. The open end of the reservoir duct 3 forms the magazine filling hole 11. The open end of the pellet chute duct 4 forms the magazine's rifle loading hole 12. The junction of two of the reservoir channel walls on the plate block across from the chute duct 4 forms a bump in the shape of a cusp 13. The form and dimensions of cusp 13 are such that a rifle pellet may move from one of the reservoir ducts past this cusp either to the other reservoir duct or to the chute duct, according to the orientation of the magazine relative to gravity. The attachment means 5 is formed by the flexible bars 14 and 16, which have each one of their ends attached to the plate block 8, the free end of the flexible bar 14 forming the hook 15, the free end of the flexible bar 16 forming the bead 17. The sliding cover 7 has the blade 18 and the sliding attachment 19, allowing for opening or closing access to the magazine filling hole 11. The magazine filling guide 6 has the base plate 20, two semi-circular plates 21 and 22 and the gate 23. This filling guide 6 has the dual purpose of helping the operation of filling the magazine with pellets, preventing the pellets from being loaded backwards into the rifle, as described next. When the magazine is to be filled with pellets, the cover 7 is moved to open the magazine filling hole 11. Each pellet is then inserted with its base and tip contacting the internal surfaces of the semi-circular plates 21 and 22. The diameter of the semi-circular parts of plates 21 and 22 is about the same as the caliber of the pellets to be used. Further, during magazine filling the orientation of the pellets must be such that their lateral profile matches the contour of the gate 23, thus allowing pellets to slide past this gate 23 and into the reservoir ducts. Unless this orientation condition is satisfied, the pellets can not go past the gate 23, thus preventing pellets from being loaded backwards into the rifle. Each of the cover plates' areas adjacent to the magazine's rifle loading hole 12 is shaped into semi-circular arcs 24 and 25. For clarity, part of the cover 9 and part of the semi-circular plate 21 in FIG. 1 have been cut away and some other parts have been exaggerated in size.

Figure 2:
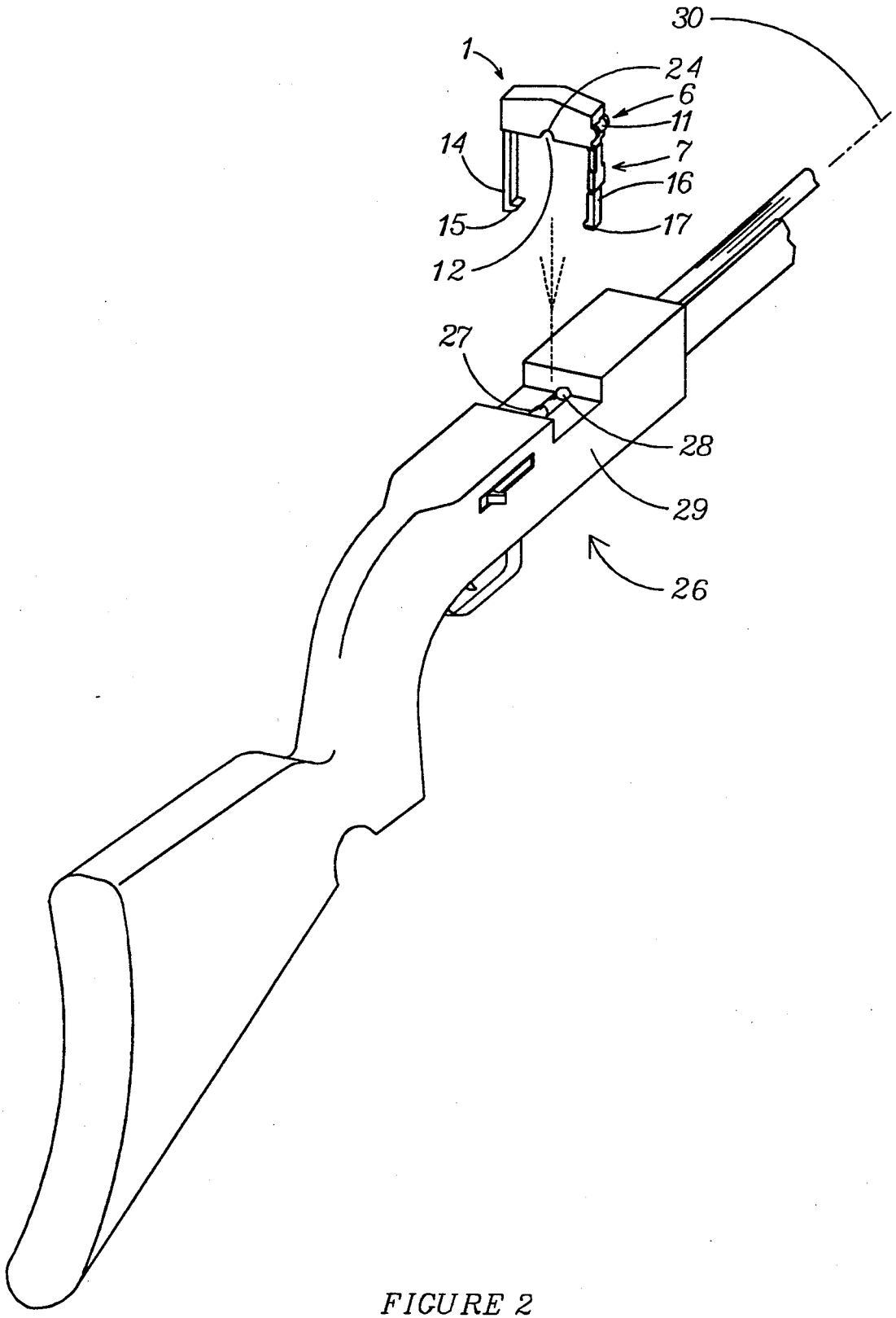
FIG. 2 illustrates the position of the magazine of FIG. 1 relative to a rifle with which it is intended to be used.

FIG. 2 shows the preferred embodiment of the magazine 1 of the invention, a rifle 26 to which the magazine is to be attached, the magazine's rifle loading hole 12 and arc 24 (one of the two arcs 24 and 25 of FIG. 1) adjacent to the magazine's rifle loading hole 12. FIG. 2 further shows the rifle's bolt 27, the rifle's breech 28, and an area 29 on the rifle's body adjacent to the breech 28. The diameters of semi-circular arc 24 (and arc 25 of FIG. 1) are such that these arcs may fit snugly on the exposed lateral surface of bolt 27 when this bolt is in its closed position. FIG. 2 further shows the position of the magazine 1 of the invention relative to the rifle 26 before attachment, the magazine 1 to be attached to the rifle in such a way that arcs 24 (and 25 of FIG. 1) will seat on the exposed lateral surface of bolt 27 when this bolt is pushed forward in its closed position closing the breech 28, the magazine to be held attached to the rifle by the flexible bars 14 and 16, hook 15 and bead 17 around the rifle's body 29 near the breech 28. When the bolt 27 is pulled back to open the rifle's breech 28, the magazine's rifle loading hole 12 will be open to the breech 28.

The dimensions of the pellet chute duct 4 (FIG. 1) are such that exactly one pellet may fit in the chute duct when the magazine 1 is attached to the rifle 26 and when the rifle's bolt 27 is in its closed position. The dimensions of the pellet reservoir ducts are such that a plurality of pellets may fit into them when magazine 1 is attached to rifle 26.

To fill the magazine with pellets, the magazine having been attached to the rifle, the rifle is held with its bore axis 30 approximately in the horizontal position with its breech closed by the bolt. Next the rifle is rotated around the bore axis 30 until the magazine's filling hole 11 is pointed upwards. The sliding cover 7 is opened to access the filling hole 11. With the rifle and the magazine in this position, pellets are inserted into the reservoir ducts through the filling hole 11 with the help of the filling guide 6. The pellets being loaded are free to pass from reservoir duct 3 to reservoir duct 2 past cusp 13 and past chute 4 until reservoir duct 2 is full. Then duct 3 may be filled. After the pellet reservoir ducts are partially filled or filled to capacity, the sliding cover 7 is slid shut.

To load one pellet from the magazine into the rifle's breech 28 the rifle is held with its bore axis 30 approximately in the horizontal position, the rifle's bolt 27 having been pushed forward, the rifle's empty breech 28 being thus closed; then the rifle is rotated around its bore axis to a position such that the axis of one of the reservoir ducts containing a pellet slopes slightly down toward the cusp 13, allowing one pellet to move into the chute duct 4. The dimensions of the chute duct are such that only one pellet can fit into it. Rotating the rifle around its bore axis until the chute duct axis is approximately vertical will cause all other pellets remaining in the reservoir ducts to roll away from the chute duct, leaving only one pellet in it. Next, the rifle's bolt 27 is pulled back, causing the pellet in the chute duct to move by gravity into the rifle's open breech 28. Moving the rifle's bolt forward will push that pellet into the rifle's bore, at the same time closing the breech 28. After the rifle is discharged, the loading cycle may be repeated by rotating the rifle with its bore axis held approximately in the horizontal position to cause another pellet to move from a pellet reservoir duct into the chute duct as described above. When loading a pellet from the magazine into the rifle's breech with the motions described, the cusp 13 will steer passage of this pellet from one of the reservoir ducts into the chute duct, blocking passage of this pellet to the other pellet reservoir duct. Obviously, this loading may be repeated until the magazine is empty of pellets, at which time the magazine filling may be repeated. The magazine also may be re-filled before it is totally emptied.

Figure 3C:
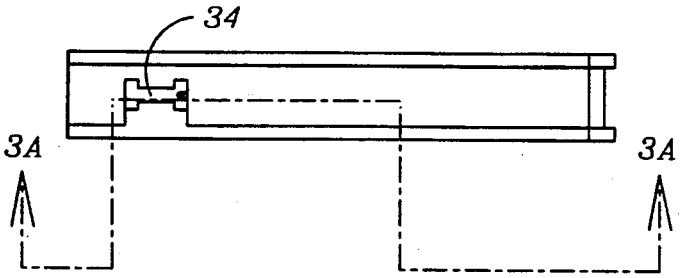
FIGS. 3A, 3B, 3C AND 3D are projection views of another embodiment of the present invention.
Figure 3A:
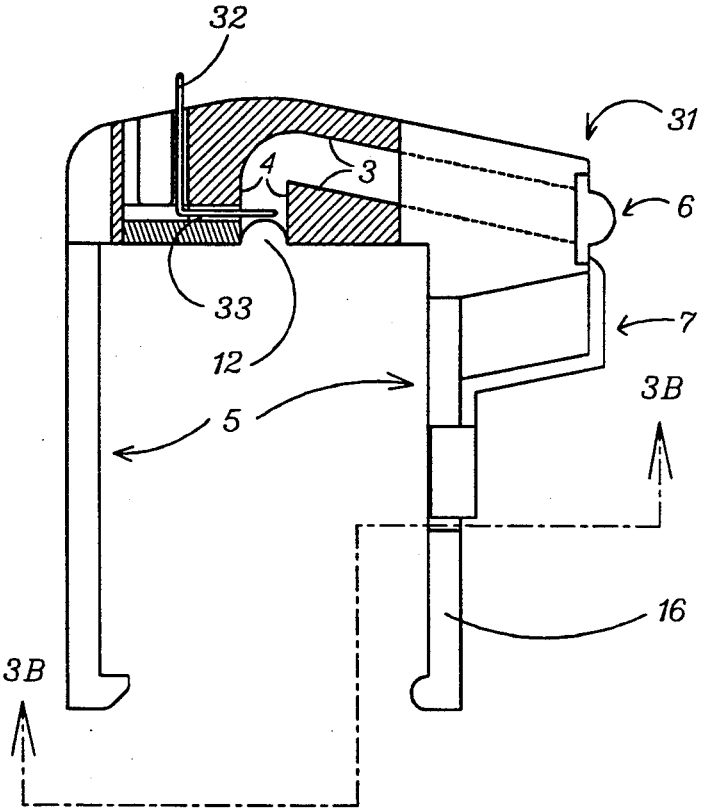
Figure 3D:
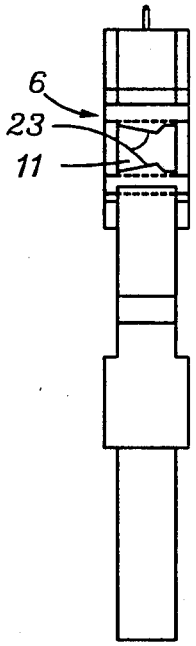
Figure 3B:
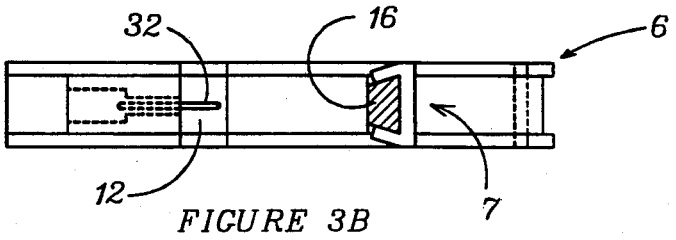

FIGS. 3A, 3B, 3C and 3D show a representation of another embodiment of the magazine of the invention. These figures constitute four projection drawings of this embodiment of the invention, showing several departures from the embodiment of the invention shown in FIG. 1. FIG. 3A shows that this embodiment of the magazine 31 of the invention has only one reservoir duct 3, but further has pin 32 and pin channel 33. FIG. 3C shows that this embodiment of the invention further has pin slot 34. The definition of the remaining referenced parts shown in FIGS. 3A, 3B, 3C and 3D is the same as the definition of the parts in FIG. 1. Thus, FIG. 3A shows the magazine filling guide 6, the chute duct 4, the sliding cover 7, the magazine's rifle loading hole 12, the magazine attachment means 5 and flexible bar 16 of the magazine attachment means. FIG. 3A also shows the path of the section 3B represented in FIG. 3B. FIG. 3B is a representation of the bottom view of the section 3B shown in FIG. 3A, showing pin 32, the magazine's rifle loading hole 12, a cut through the dovetailed portion of the flexible bar 16, a bottom view of the sliding cover 7 used in this embodiment of the invention, and a bottom view of part of the magazine filling guide 6. FIG. 3C shows a representation of the top view of the magazine shown in FIG. 3A, showing the path of the section 3A represented in FIG. 3A and the pin slot 34. FIG. 3D shows a representation of the side view of the magazine 31 of FIG. 3A, further showing a side view of the magazine filling guide 6 and the contour of the gate 23 which sets a boundary to the access to the magazine filling hole 11.

The operation of the magazine 31 of FIG. 3A only differs from the operation of magazine 1 of FIG. 1 in that sliding pin 32 in pin channel 33 and pin slot 34 either blocks or frees the movement of pellets out of the chute duct 4 through the magazine's rifle loading hole 12. Thus, the operation of filling the magazine 31 with pellets differs from the operation described for the embodiment of magazine 1 of FIG. 1 in that the filling may be performed before attaching the magazine to the rifle, so that magazine 31 may operate in the manner of a clip due to the action of pin 32. Several magazines of this type may be pre-filled for convenience. However, this embodiment of the magazine 31 of the invention may also be filled with pellets after it is attached to the rifle.

The operation of loading pellets into the rifle from the embodiment of the magazine 31 of the invention is the same as the operation for the embodiment shown in FIG. 1.

The preferred material to be used in the embodiments of the invention is plastic, using the technology of plastic molding. Metals can also be used.

Changes in the embodiments of the invention that are well within its spirit and scope may suggest themselves to those skilled in the art. For example, the reservoir duct 3 of FIG. 3A may be extended and folded along the flexible bar 16 of FIG. 3A, thus increasing the capacity of the magazine of the invention for holding a plurality of pellets. Thus, although the invention has been described and illustrated with reference to specific examples in detail, it should be clearly understood that these disclosures and descriptions should not be taken as limiting in any sense other than the scope of the appended claims.

I claim:

1. A gravity operated magazine for loading pellets into rifles and smooth barrel shoulder guns of the single shot type that use pellets as projectiles and shoot said pellets through a bore through said barrel along an axis, that further have loading mechanisms which include a bolt, that use as pellet propellant either compressed air (precharged or provided by a pump) or carbon dioxide cartridges, said magazine comprising:

a plate block of thickness larger than the length of said pellets, said block having three channels, said channels having their long axes parallel to said plate block's two largest surfaces, said channels being of a width larger than the caliber of said pellets, two of the three said channels being pellet reservoir channels, the third of said channels being a pellet chute channel, one first end of a first pellet reservoir channel being connected to one first end of the second pellet reservoir channel, the second end of the first pellet reservoir channel being closed, the second end of the second pellet reservoir channel being open, the two connected ends of the pellet reservoir channels being further connected to one first end of the pellet chute channel, the second end of the pellet chute channel being open;

two cover plates, one first surface of one first cover plate being attached to one first surface of the two largest surfaces of said block, one first surface of the second cover plate being attached to the second of the two largest surfaces of said block, said two pellet reservoir channels and said cover plates forming two pellet reservoir ducts, said pellet chute channel and said cover plates forming one pellet chute duct, said reservoir ducts and chute duct being able to contain one rifle pellet or a plurality of rifle pellets lying side by side to each other, said pellets being free to roll along inside said reservoir ducts and chute duct propelled by gravity, the open end of the second pellet reservoir channel and the cover plates forming a magazine filling hole allowing said magazine to be filled with pellets through said magazine filling hole, the open end of the pellet chute channel and the cover plates forming a magazine's rifle loading hole, allowing said pellets to be loaded from said magazine into the breech of said rifle through said magazine's rifle loading hole, the edges of the cover plates adjacent to said magazine's rifle loading hole being shaped into two identical arcs encompassing approximately 180 degrees, the arcs further having diameters of dimensions as required to seat snugly said arcs on the exposed lateral surface of said rifle's bolt adjacent to said rifle's breech when said bolt is in closed position, thus enabling said bolt to close said magazine's rifle loading hole when said bolt is in closed position;

a means for attaching said magazine to the breech of said rifle, causing a plane parallel to the axes of said reservoir ducts and chute duct to lie perpendicularly to the rifle's bore axis, further causing said magazine's rifle loading hole arcs to seat on the exposed lateral surface of the rifle's bolt when said bolt is in closed position; and a means for opening or closing said magazine filling hole.

2. The magazine of claim 1 wherein the means for attaching said magazine to said rifle is permanent.

3. The magazine of claim 1 wherein the rifle body includes a rectangular cross section portion adjacent the breech, and the means for attaching said magazine to said rifle allows for attachment or removal of said magazine, said means comprising:

a first flexible bar having a first end attached to a first side of said block, said bar further having a hook at a second end of said bar to engage onto said rifle's body around said rifle's rectangular cross section adjacent to said rifle's breech; and a second flexible bar having a first end attached to a second side of said block, said bar having further a bead at the second end of said bar to engage onto said rifle's body, the spacing between the first flexible bar and the second flexible bar being such as to straddle and lock around said rifle's body, the second flexible bar being approximately parallel to the first flexible bar.

4. The magazine of claim 1 wherein the means for opening or closing said magazine filling hole is a sliding cover comprising:

a blade to cover said magazine filling hole; and a means for providing a sliding attachment of said blade to said magazine.

5. The magazine of claim 1 further comprising a pellet deflection means for deflecting pellets from a first pellet reservoir duct into the pellet chute duct during rifle loading, said means further preventing said pellets from passing from a first pellet reservoir duct into the second pellet reservoir duct during said rifle loading, said means further allowing free pellet passage from a first pellet reservoir duct into the second pellet reservoir duct while filling said magazine with pellets.

6. The magazine of claim 5 wherein said pellet deflection means is a bump situated at the channel wall opposite the pellet chute duct at the junction of a first pellet reservoir channel duct with the second pellet reservoir channel duct.

7. The magazine of claim 6 wherein said bump's cross section in a plane parallel to the plane containing the axes of said channels is a cusp.

8. The magazine of claim 1 having a means for guiding pellets into said magazine filling hole during magazine filling.

9. The magazine of claim 8 wherein the means for guiding pellets into said magazine filling hole is attached to said magazine in the area adjacent to said magazine filling hole, said means comprising:

a rectangular base plate, said base plate having a hole matching said magazine filling hole; and two semi-circular plates having diameters of about the caliber of said pellets, each having one first surface coplanar with one internal surface of each cover plate, the second surfaces of each said semi-circular plates facing away from each other, said semi-circular plates being attached perpendicularly to said rectangular base plate adjacent to said base plate hole.

10. The magazine of claim 9 wherein the means for guiding pellets into said magazine filling hole further comprises a gate partially occluding said plate hole to prevent filling said magazine with pellets having the front end of said pellets turned around backwards.

11. The magazine of claim 10 wherein the perimeter of said gate hole has a shape similar to the perimeter of a pellet's cross section taken in a plane through said pellet's axis.

12. The magazine of claim 1 wherein, in normal operation, the pellet chute duct is approximately vertical, the pellet reservoir ducts further sloping downwards away from said junction of said three ducts.

13. The magazine of claim 1 wherein the pellet reservoir ducts may hold a plurality of pellets and the pellet chute duct may not hold more than one pellet.

14. A gravity operated magazine for loading pellets into rifles and smooth barrel shoulder guns of the single shot type that use pellets as projectiles and shoot said pellets through a bore through said barrel along an axis, that further have loading mechanisms that include a bolt, that use as pellet propellant either compressed air (precharged or provided by a pump) or carbon dioxide cartridges, said magazine comprising:

A plate block having sufficient thickness to exceed the length of said pellets, said block having two channels, said channels having their long axes parallel to said plate block's two largest surfaces, said channels being of sufficient width to exceed the caliber of said pellets, one first channel being a pellet reservoir channel, the second channel being a pellet chute channel, one first end of the pellet reservoir channel being connected to one first end of the pellet chute channel, the second end of the pellet reservoir channel being open, the second end of the pellet chute channel being open;

two cover plates, one first surface of one first cover plate being attached to one first surface of the two largest surfaces of said block, one first surface of the second cover plate being attached to the second end of the two largest surfaces of said block, said pellet reservoir channel and said cover plates forming a pellet reservoir duct, said pellet chute channel and said cover plates forming one pellet chute duct, said ducts being able to contain one rifle pellet or a plurality of rifle pellets lying side by side to each other, said pellets being free to roll along inside said ducts propelled by gravity, the open end of the pellet reservoir channel and the cover plates forming a magazine filling hole allowing said magazine to be filled with pellets through said magazine filling hole, the open end of the pellet chute channel and the cover plates forming a magazine's rifle loading hole, allowing said pellets to be loaded from said magazine into the breech of said rifle through said magazine's rifle loading hole, the edges of the cover plates adjacent to said magazine's rifle loading hole being shaped into two identical arcs encompassing approximately 180 degrees, the arcs further having diameters of dimensions as required to seat snugly said arcs on the exposed lateral surface of said rifle's bolt adjacent to said rifle's breech when said bolt is in closed position, thus enabling said bolt to close said magazine's rifle loading hole when said bolt is in closed position;

a means for attaching said magazine to the breech of said rifle, causing a plane parallel to the axes of said reservoir duct and chute duct to lie perpendicularly to the rifle's bore axis, further causing said magazine's rifle loading hole arcs to seat on the exposed lateral surface of said rifle's bolt when said bolt is in closed position; and a means for opening or closing said magazine filling hole.

15. The magazine of claim 14 wherein the means for attaching said magazine to said rifle is permanent.

16. The magazine of claim 14 wherein the rifle body includes a rectangular cross-section portion adjacent the breech, and the means for attaching said magazine to said rifle allows for attachment or removal of said magazine, said means comprising:

a first flexible bar having a first end attached to a first side of said block, said bar further having a hook at the second end of said bar to engage onto said rifle's body around said rifle's rectangular cross section adjacent to said rifle's breech; and a second flexible bar having a first end attached to a second side of said block, said bar having further a bead at the second end of said bar to engage onto said rifle's body, the spacing between the first flexible bar and the second flexible bar being such as to straddle and lock around said rifle's body, the second flexible bar being approximately parallel to the first flexible bar.

17. The magazine of claim 14 wherein the means for opening or closing said magazine filling hole is a sliding cover comprising:

a blade to cover said magazine filling hole; and a means for providing a sliding attachment of said blade to said magazine.

18. The magazine of claim 14 having a means for guiding pellets into said magazine filling hole during magazine filling.

19. The magazine of claim 18 wherein the means for guiding pellets into said magazine filling hole is attached to said magazine in the area adjacent to said magazine filling hole, said means comprising:

a rectangular base plate, said base plate having a hole matching said magazine filling hole; and two semi-circular plates having diameters of about the caliber of said pellets, each having one first surface coplanar with one internal surface of each cover plate, the second surfaces of each said semi-circular plates facing away from each other, said semi-circular plates being attached perpendicularly to said rectangular base plate adjacent to said base plate hole.

20. The magazine of claim 19 wherein the means for guiding pellets into said magazine filling hole further comprises a gate partially occluding said base plate hole to prevent filling said magazine with pellets having the front end of said pellets turned around backwards.

21. The magazine of claim 20 wherein the perimeter of said gate hole has a shape similar to the perimeter of a pellet's cross section taken in a plane through said pellet's axis.

22. The magazine of claim 14 wherein, in normal operation, the pellet chute duct is approximately vertical, the pellet reservoir duct further sloping downwards away from said junction of said two ducts.

23. The magazine of claim 14 wherein the pellet reservoir duct may hold a plurality of pellets and the pellet chute duct may not hold more than one pellet.

24. The magazine of claim 14 further comprising a means for preventing or allowing the passage of pellets through said magazine's rifle loading hole into the breech of said rifle.

25. The magazine of claim 24 wherein the means for preventing or allowing the passage of pellets through said magazine's rifle loading hole into the breech of said rifle comprises:

a pin channel formed into said block of said magazine, the axis of said channel being perpendicular to the axis of said pellet chute duct, one first end of said pin channel being adjacent to the open end of said pellet chute duct;

a pin slot formed into said block of said magazine in a plane parallel to the axes of said reservoir and chute ducts, one first end of said slot being open, the second end of said slot being connected to the second end of said pin channel; and a movable pin being bent forming two arms at an angle of approximately 90 degrees, one arm of said pin lying partially inside said pin channel, the second arm of said pin lying partially inside said pin slot, a first end of said pin being adjacent to the open end of said chute duct, said pin end being able to block or free the movement of said pellets out of said chute duct through said magazine's rifle loading hole when said pin moves back and forth in said pin channel, the second end of said pin protruding out of said block of said magazine through said pin slot, said second pin end thus allowing for manual motion of said pin.

* * * * *